US010788775B2

(12) United States Patent
Okamoto et al.

(10) Patent No.: US 10,788,775 B2
(45) Date of Patent: Sep. 29, 2020

(54) FIXING DEVICE AND IMAGE FORMING APPARATUS INCLUDING SAME

(71) Applicants: Jun Okamoto, Tokyo (JP); Seiji Saitoh, Kanagawa (JP); Yutaka Naitoh, Kanagawa (JP); Toshiharu Hachisuka, Kanagawa (JP); Hiroshi Seo, Kanagawa (JP); Daisuke Inoue, Tokyo (JP); Masao Katoh, Kanagawa (JP); Yutaka Aso, Kanagawa (JP); Naohiro Funada, Kanagawa (JP); Tomoo Asami, Kanagawa (JP)

(72) Inventors: Jun Okamoto, Tokyo (JP); Seiji Saitoh, Kanagawa (JP); Yutaka Naitoh, Kanagawa (JP); Toshiharu Hachisuka, Kanagawa (JP); Hiroshi Seo, Kanagawa (JP); Daisuke Inoue, Tokyo (JP); Masao Katoh, Kanagawa (JP); Yutaka Aso, Kanagawa (JP); Naohiro Funada, Kanagawa (JP); Tomoo Asami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/752,816

(22) Filed: Jan. 27, 2020

(65) Prior Publication Data

US 2020/0241453 A1 Jul. 30, 2020

(30) Foreign Application Priority Data

Jan. 29, 2019 (JP) ..... 2019-012938

(51) Int. Cl.
*G03G 15/20* (2006.01)
*G03G 21/16* (2006.01)

(52) U.S. Cl.
CPC ..... *G03G 15/2039* (2013.01); *G03G 15/2053* (2013.01); *G03G 21/1685* (2013.01)

(58) Field of Classification Search
CPC ..... G03G 15/2035; G03G 15/2039; G03G 15/2053; G03G 15/2064; G03G 15/5045;
(Continued)

(56) References Cited

U.S. PATENT DOCUMENTS 6,104,889 A 8/2000 Saitoh
8,385,764 B2 * 2/2013 Takahashi ..... G03G 15/2039 399/69

(Continued)

FOREIGN PATENT DOCUMENTS

JP 4-217288 8/1992
JP 2002-287473 10/2002

(Continued)

*Primary Examiner* — Hoan H Tran
(74) *Attorney, Agent, or Firm* — Harness, Dickey & Pierce, P.L.C.

(57) ABSTRACT

A fixing device includes a fixing member, at least one temperature detector, and a device-side drawer connector. The at least one temperature detector is configured to detect a temperature of the fixing member, the at least one temperature detector including a plurality of lead wires. The device-side drawer connector has a terminal portion configured to fit with a terminal portion of a body-side drawer connector of an image forming apparatus body to connect the plurality of lead wires of the at least one temperature detector to the image forming apparatus body. The device-side drawer connector is configured to branch a signal wire of the plurality of lead wires of the at least one temperature detector into a plurality of systems. A plurality of earth wires of the plurality of lead wires of the at least one temperature detector is short-circuited to each other.

6 Claims, 7 Drawing Sheets

(58) Field of Classification Search
CPC ..... G03G 21/1685; G03G 2221/1639; G03G 2221/166
USPC ..... 399/9, 31, 33, 38, 67, 69
See application file for complete search history.

(56) References Cited

U.S. PATENT DOCUMENTS

| | | | | |
|---|---|---|---|---|
| 9,696,679 | B2 * | 7/2017 | Kanai | G03G 15/80 |
| 9,927,746 | B2 * | 3/2018 | Kuroda | G03G 15/2053 |
| 10,133,226 | B2 * | 11/2018 | Kurotsu | G03G 15/2064 |
| 10,222,730 | B2 * | 3/2019 | Kurahashi | G03G 21/1685 |
| 1,053,991 | A1 | 1/2020 | Hase et al. | |
| 2006/0239707 | A1 | 10/2006 | Saitoh | |
| 2011/0064440 | A1 | 3/2011 | Saitoh | |
| 2015/0220029 | A1 | 8/2015 | Samei et al. | |
| 2016/0274510 | A1 | 9/2016 | Hase et al. | |

FOREIGN PATENT DOCUMENTS

| | | |
|---|---|---|
| JP | 2006-147181 | 6/2006 |
| JP | 2010-072073 | 4/2010 |
| JP | 2014-225374 | 12/2014 |

* cited by examiner

FIXING DEVICE AND IMAGE FORMING APPARATUS INCLUDING SAME

CROSS-REFERENCE TO RELATED APPLICATION

This patent application is based on and claims priority pursuant to 35 U.S.C. § 119(a) to Japanese Patent Application No. 2019-012938, filed on Jan. 29, 2019, in the Japan Patent Office, the entire disclosure of which is incorporated by reference herein.

BACKGROUND

Technical Field

Aspects of the present disclosure relate to a fixing device and an image forming apparatus including the fixing device.

Related Art

A fixing device in an electrophotographic image forming apparatus includes: a heating device such as a fixing roller having a built-in heater; and a temperature detector such as a thermistor that controls a fixing temperature. The fixing device (fixing unit) is often attachable to/detachable from the image forming apparatus for the purposes of: improving a paper jam handling property; and replacing a unit. The heating device and the temperature detector supply electric power from an apparatus body to the heater and transmit a detection temperature of a thermistor element portion to a controller of the apparatus body by connection between terminal portions at a drawer connector. The terminal portions are provided on the fixing device and the image forming apparatus body side of the drawer connector, respectively.

However, in a conventional drawer connector, defective contact such as increase in electrical resistance or defective electrical continuity has occurred sometimes. The defective contact is caused as follows: when a metal-plated layer of a terminal contact portion is exposed to high-temperature and high-humidity conditions and subjected to abrasion by fine sliding motions of a fixing device at the time of attachment/detachment of the fixing device or vibration during operation of an apparatus body, the metal-plated layer of the terminal contact portion is peeled off, and nickel plating on an underlying layer is exposed, and then the terminal portion is oxidized. As a result, a detection error of a thermistor detection temperature is caused.

SUMMARY

In an aspect of the present disclosure, there is provided a fixing device that includes a fixing member, at least one temperature detector, and a device-side drawer connector. The at least one temperature detector is configured to detect a temperature of the fixing member, the at least one temperature detector including a plurality of lead wires. The device-side drawer connector has a terminal portion configured to fit with a terminal portion of a body-side drawer connector of an image forming apparatus body to connect the plurality of lead wires of the at least one temperature detector to the image forming apparatus body. The device-side drawer connector is configured to branch a signal wire of the plurality of lead wires of the at least one temperature detector into a plurality of systems. A plurality of earth wires of the plurality of lead wires of the at least one temperature detector is short-circuited to each other.

In an aspect of the present disclosure, there is provided an image forming apparatus including the fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
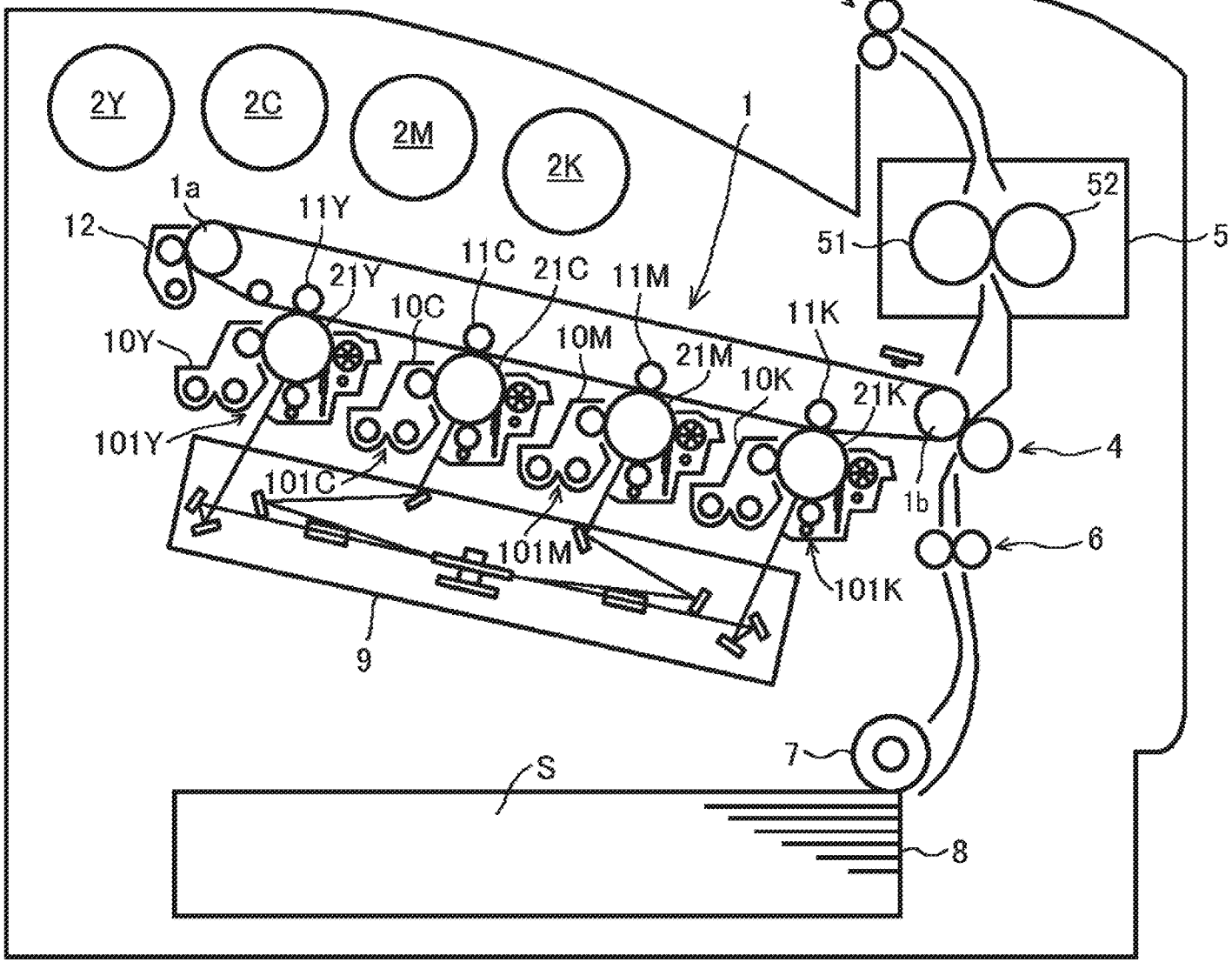
FIG. 1 is a schematic configuration diagram of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a color laser printer (hereinafter also simply referred to as "printer") that is an image forming apparatus according to an embodiment of the present disclosure will be described. FIG. 1 is a schematic configuration diagram of a printer according to the present embodiment. This printer includes a tandem image former including four image forming devices of yellow, cyan, magenta, and black which are arranged side by side. In the tandem image former, image forming devices 101Y, 101C, 101M, and 101K as individual toner image forming devices are sequentially arranged from the left in the drawing. Here, suffixes Y, C, M, and K of the respective reference signs represent members of yellow, magenta, cyan, and black, respectively. Additionally, the individual image forming devices 101Y, 101C, 101M, and 101K of the tandem image former include charging devices, developing devices 10Y, 10C, 10M, and 10K, photoconductor cleaning devices, and the like which are arranged respectively around drum-shaped photoconductors 21Y, 21C, 21M, and 21K as latent image bearers. The printer includes, in an upper portion of the printer, toner bottles 2Y, 2C, 2M, and 2K respectively filled with toner of the respective colors of yellow, cyan, magenta, and black. The developing devices 10Y, 10C, 10M, and 10K are supplied with predetermined supply amounts of the toner respectively from the toner bottles 2Y, 2C, 2M, and 2K through conveyance paths provided in the image forming apparatus.

Additionally, an optical writing unit 9 as a latent image forming device is provided below the tandem image former. The optical writing unit 9 includes a light source, a polygon mirror, an f-θ lens, a reflection mirror, and the like, and irradiates the surfaces of the respective photoconductors 21 with laser light while scanning the surfaces with the laser light based on image data.

Additionally, an intermediate transfer belt 1 of an endless belt type is provided as an intermediate transferor immediately above the tandem image former. The intermediate transfer belt 1 is passed around support rollers 1*a* and 1*b*, and a drive motor as a driving source is connected to a rotation shaft of the support roller 1*a* functioning as a drive roller among these support rollers. When this drive motor is driven, the intermediate transfer belt 1 is rotationally moved in a counterclockwise direction in the drawing, and also the support roller 1*b* that can be driven is rotated. The intermediate transfer belt 1 includes, on an inner side of the intermediate transfer belt, primary transfer devices 11Y 11C, 11M, and 11K to transfer, onto the intermediate transfer belt 1, the toner images on the photoconductors 21Y, 21C, 21M, and 21K.

Additionally, the intermediate transfer belt 1 includes a secondary transfer roller 4 as a secondary transfer device more on a downstream side than the primary transfer devices 11Y, 11C, 11M, and 11K in the driving direction of the intermediate transfer belt 1. The support roller 1*b* is arranged on an opposite side of the secondary transfer roller 4 while interposing the intermediate transfer belt 1, and functions as a pressing member. Additionally, a sheet tray 8, a sheet feeding roller 7, a registration roller 6, and the like are provided. Further provided are a fixing device 5 and an output roller pair 3 at a downstream portion of the secondary transfer roller 4 in an advancing direction of a recording medium S on which the toner image has been transferred by the secondary transfer roller 4. The fixing device 5 fixes the image on the recording medium S.

Next, operation of the printer will be described. The photoconductors 21Y, 21C, 21M, and 21K are respectively rotated in the individual image forming devices, and the surfaces of the photoconductors 21Y, 21C, 21M, and 21K are first uniformly charged by charging devices 17Y 17C, 17M, and 17K along with the rotation of the photoconductors 21Y, 21C, 21M, and 21K. Subsequently, writing laser light is emitted from the optical writing unit 9 based on image data to form electrostatic latent images on the photoconductors 21Y, 21C, 21M, and 21K. After that, the toner is made to adhere by the developing devices 10Y, 10C, 10M, and 10K, and the electrostatic latent images are visualized to form respective monochromatic images of yellow, cyan, magenta, and black on the respective photoconductors 21Y, 21C, 21M, and 21K. Additionally, the support roller 1*a* as the drive roller is rotationally driven by the drive motor provided in the image forming apparatus to rotationally drive the other support roller 1*b* as a driven roller and the secondary transfer roller 4, and rotationally convey the intermediate transfer belt 1. Then, the visible images are sequentially transferred onto the intermediate transfer belt 1 at the primary transfer devices 11Y, 11C, 11M, and 11K. Thus, a composite color image is formed on the intermediate transfer belt 1. The surfaces of the photoconductors 21Y, 21C, 21M, and 21K after the image transfer have residual toner removed by the respective photoconductor cleaning devices to prepare for image formation again.

Further, a leading edge of the recording medium S is fed out from the sheet tray 8 by the sheet feeding roller 7, conforming to timing of image formation. Then, the recording medium S is conveyed to the registration roller 6 and stopped temporarily. Subsequently, the recording medium S is conveyed between the secondary transfer roller 4 and the intermediate transfer belt 1, conforming to the timing of image forming operation. Here, the intermediate transfer belt 1 and the secondary transfer roller 4 form a so-called secondary transfer nip while sandwiching the recording medium S, and the toner image on the intermediate transfer belt 1 is secondarily transferred onto the recording medium S at the secondary transfer roller 4.

After the image transfer, the recording medium S is sent to the fixing device 5, and the recording medium S is conveyed and nipped at a nip portion formed by a fixing member 51 and a pressure member 52 to heat and pressurize the toner image on the recording medium S and fix the toner image on the recording medium S. The fixing member 51 has a surface kept at a predetermined temperature, and the pressure member 52 faces the fixing member 51 and is pressed against the fixing member 51. Furthermore, the recording medium S ejected from the nip portion is separated by a separator and then ejected from the output roller pair 3 to the outside of the apparatus. On the other hand, the intermediate transfer belt 1 after the image transfer has residual toner remaining on the intermediate transfer belt 1, and the residual toner is removed by an intermediate transferor cleaning device 12 to prepare again for image formation by the tandem image former.

Figure 7:
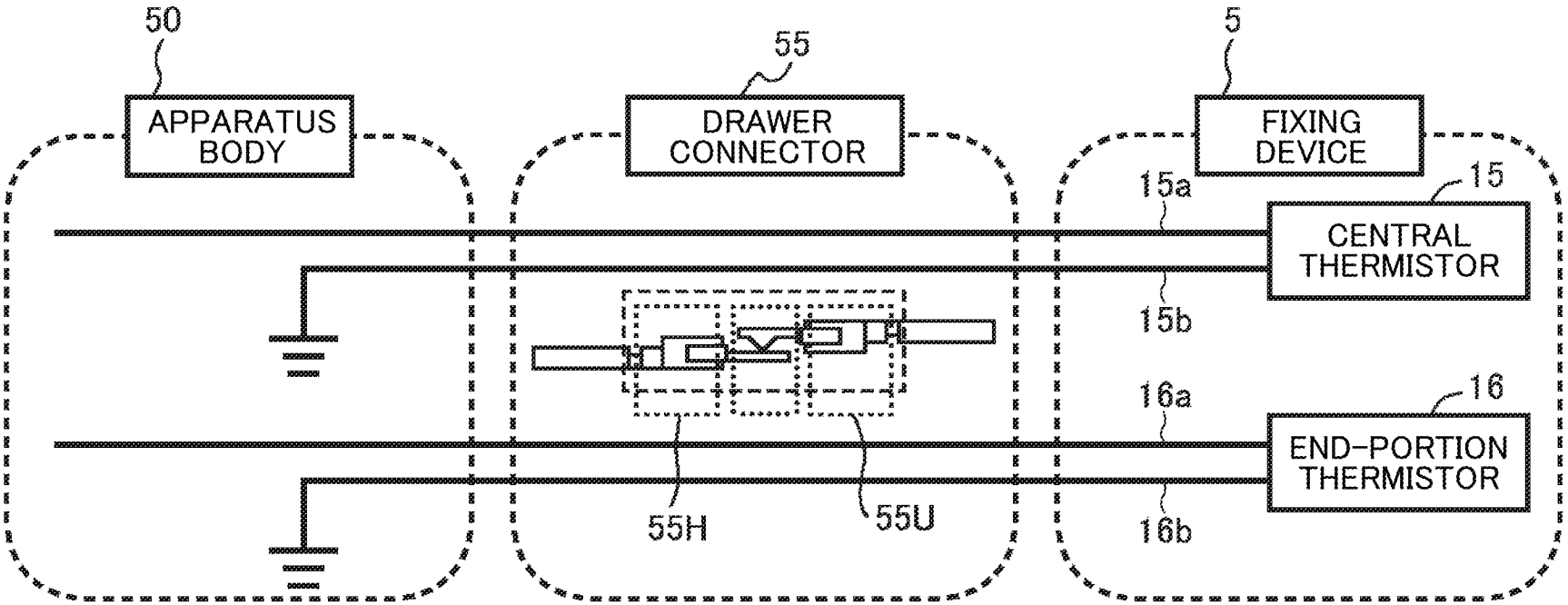
FIG. 7 is a schematic configuration diagram of a drawer connector according to a comparative example.

FIG. 7 is a schematic configuration diagram of a drawer connector according to a comparative example. A drawer connector 55 includes a fixing device side connector 55U and a body-side connector 55H and is arranged between a fixing device 5 and an apparatus body (image forming apparatus body) 50. The fixing device side connector 55U is installed on the fixing device 5, and the body-side connector 55H is installed on the apparatus body 50. A central thermistor 15 (hereinafter also referred to as the thermistor 15) and an end-portion thermistor 16 (hereinafter also referred to as the thermistor 16) are temperature detectors, and each of the thermistors includes two lead wires. Specifically, the central thermistor 15 includes the two lead wires of a signal wire 15*a* and an earth wire 15*b*, and the end-portion thermistor 16 includes the two lead wires of a signal wire 16*a* and an earth wire 16*b*. The central thermistor 15 is arranged at a center in a longitudinal direction of the fixing device 5, and the end-portion thermistor 16 is arranged at an end portion in the longitudinal direction of the fixing device 5.

The signal wires 15*a* and 16*a* and the earth wires 15*b* and 16*b* of the thermistors 15 and 16 are connected to the fixing device side connector 55U on the fixing device 5 side of the drawer connector 55 via a relay connector, or directly connected to the fixing device side connector 55U. Thus, the signal wires 15*a*, 16*a* and the earth wires 15*b*, 16*b* are each connected to one terminal in the fixing device side connector 55U of the drawer connector 55.

On the other hand, terminals corresponding to the terminals of the fixing device side connector 55U side are also provided on the body-side connector 55H side of the apparatus body 50 side. The drawer connector 55 is a snap-in connector including a pair of male and female connectors. Therefore, when the fixing device 5 is set in the apparatus body 50, the terminal of the signal wire 15*a* and the terminal of the earth wire 15*b* are connected in a pair and the terminal of the signal wire 16*a* and the terminal of the earth wire 16*b* are connected in a pair, and a contact of one system (signal path) is formed by each of the pairs. A place where a terminal of the body-side connector 55H and a terminal of the fixing device side connector 55U are in contact with each other is a contact.

Figure 2:
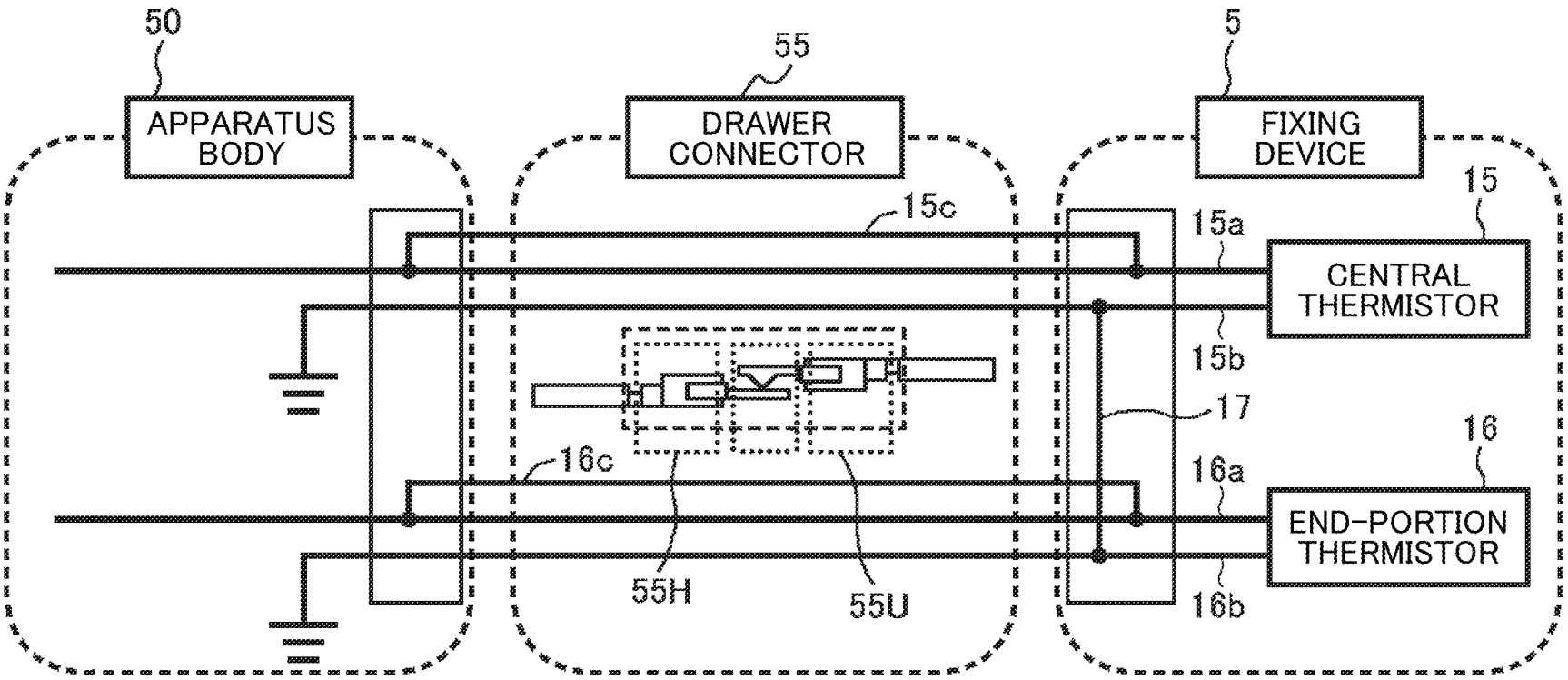
FIG. 2 is a schematic configuration diagram of a drawer connector according to an embodiment of the present disclosure.

FIG. 2 is a schematic configuration diagram of a drawer connector according to an embodiment of the present disclosure. A central thermistor 15 and an end-portion thermistor 16 are temperature detectors that detect a temperature of the fixing member 51. Each of the thermistors includes two lead wires. Specifically, the central thermistor 15 includes the two lead wires of a signal wire 15*a* and an earth wire 15*b*, and the end-portion thermistor 16 includes the two lead wires of a signal wire 16*a* and an earth wire 16*b*. Here, a system in each of the signal wire 15*a* of the thermistor 15 and the signal wire 16*a* of the thermistor 16 is branched into a plurality of systems at a portion of the fixing device side connector 55U of the fixing device 5. Then, the respective signal wires 15*a* and 16*a* are connected to the terminals or the signal wires 15*c* and 16*c* added by the system increase from one system to two systems. Additionally, the two earth wires 15*b* and 16*b* of the thermistors 15 and 16 are mutually short-circuited by a short-circuit wire 17. With this configuration, even in a case where defective contact occurs at one contact out of a plurality of contacts at the terminal portions of the signal wires and the terminal portions of the earth wires, another signal wire and another earth wire each of which has a secured contact prevents defective electrical continuity at the terminal portions. Thus, occurrence of a temperature detection error of the temperature detectors can be suppressed. The body-side connector 55H also includes terminals of branched signal wires in a manner corresponding to the terminals of the fixing device side connector 55U of the fixing device 5 to connect the signal wires on the apparatus body side. Thus, compared to the comparative example, the number of lead wires of the signal wires 15*c* and 16*c* and the short-circuit wire 17 are added in the present embodiment, and the contacts (signal paths) of the plurality of systems (the two systems in the present embodiment) are formed in the drawer connector 55. However, the number of signal paths is not limited to the two systems, and signal paths of three or more systems may also be formed. Also, one temperature detector that detects a temperature of the fixing member 51 may be provided.

Accordingly, the fixing device 5 according to the present embodiment is the fixing device including one or a plurality of thermistors 15 and 16 as the temperature detectors that detect the temperature of the fixing member 51. The lead wire in each of the thermistors is connected by mutual fitting between the terminal portion on the fixing device 5 side and the terminal portion on the apparatus body 50 side at the drawer connector 55. The system in each of the signal wires 15*a* and 16*a* of the thermistors 15 and 16 is branched into the plurality, of systems at the portion of the drawer connector 55, and the plurality of earth wires 15*b* and 16*b* is short-circuited to each other.

Figure 3:
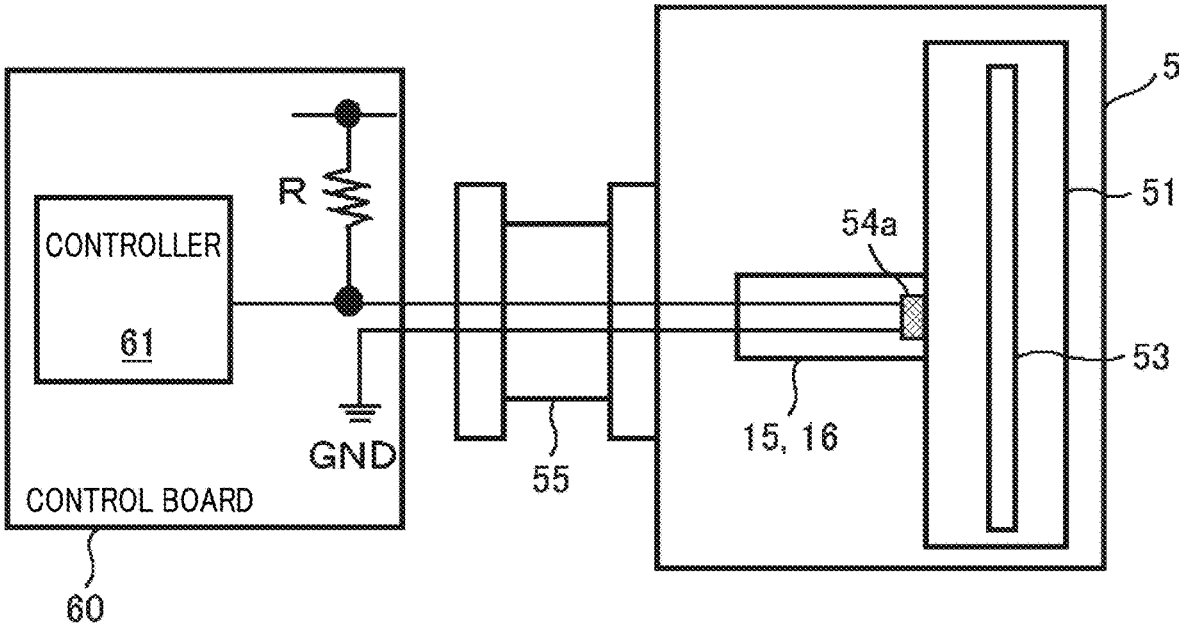
FIG. 3 is a diagram illustrating an exemplary temperature detection circuit of a fixing device according to an embodiment of the present disclosure.

FIG. 3 is a diagram illustrating an exemplary temperature detection circuit of the fixing device according to an embodiment of the present disclosure. The thermistors 15 and 16 as the temperature detectors provided in the fixing device 5 include a thermistor element 54*a* where a resistance value is changed by change in a temperature. The thermistors detect a temperature of the fixing member 51 based on the change in the resistance value. Here, a thermistor is used as the temperature detector, but the temperature detector is not limited to the thermistor. The thermistors 15 and 16 have current flowing through the drawer connector 55 from a controller 61 of a control board 60 provided in the apparatus body 50. Further, the controller 61 detects voltage that is changed by the change in the resistance at the thermistor element 54*a*, and controls energization of the heating member 53 to control the temperature of the fixing member 51.

Figure 4:
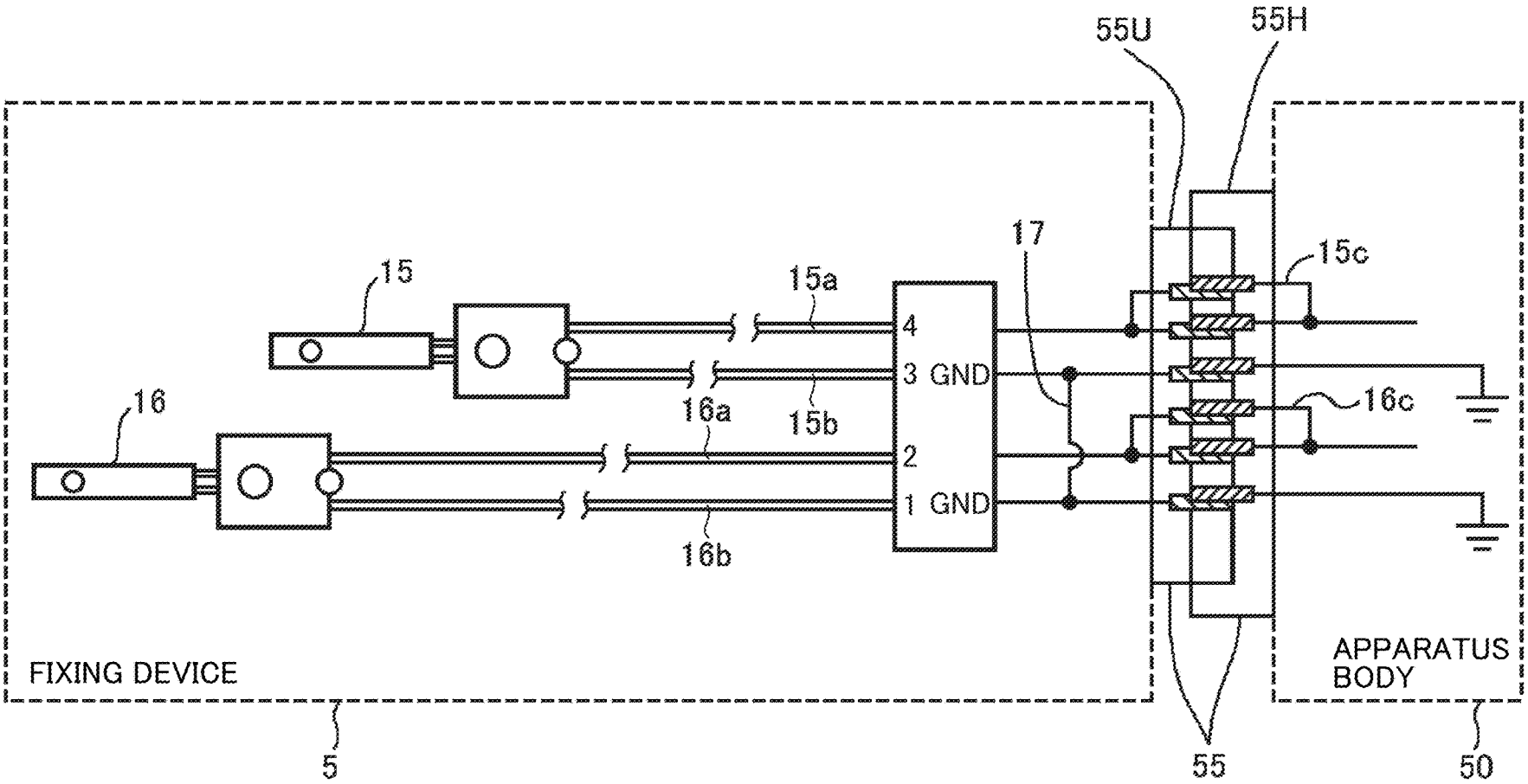
FIG. 4 is a diagram illustrating details of increasing a wire to a plurality of wires at a thermistor portion.

FIG. 4 is a diagram illustrating details of increasing a wire to a plurality of wires at a thermistor portion. The signal wire 15*a* of the central thermistor 15 is branched into the signal wire 15*a* and the signal wire 15*c* at the fixing device side connector 55U and the body-side connector 55H at a fitting portion between the fixing device side connector 55U of the fixing device 5 and the body-side connector 55H of the apparatus body 50 side. The branched signal wires are reverted to the one signal wire 15*a* on the apparatus body 50 side. Similarly, the signal wire 16*a* of the end-portion thermistor 16 is also branched into the signal wire 16*a* and the signal wire 16*c* at the fixing device side connector 55U and the body-side connector 55H. The branched signal wires are reverted to the one signal wire 16*a* on the apparatus body 50 side.

On the other hand, the earth wire 15*h* of the central thermistor 15 and the earth wire 16*b* of the end-portion thermistor 16 are short-circuited between the fixing device side connector 55U and the body-side connector 55H and between the central thermistor 15 and the end-portion thermistor 16 by the short-circuit wire 17. The short-circuit wire 17 may be arranged between the fixing device side connector 55U and the body-side connector 55H, may be arranged between the central thermistor 15 and the end-portion thermistor 16, or may be arranged between the fixing device side connector 55U, the body-side connector 55H, and the apparatus body 50.

Figure 5:
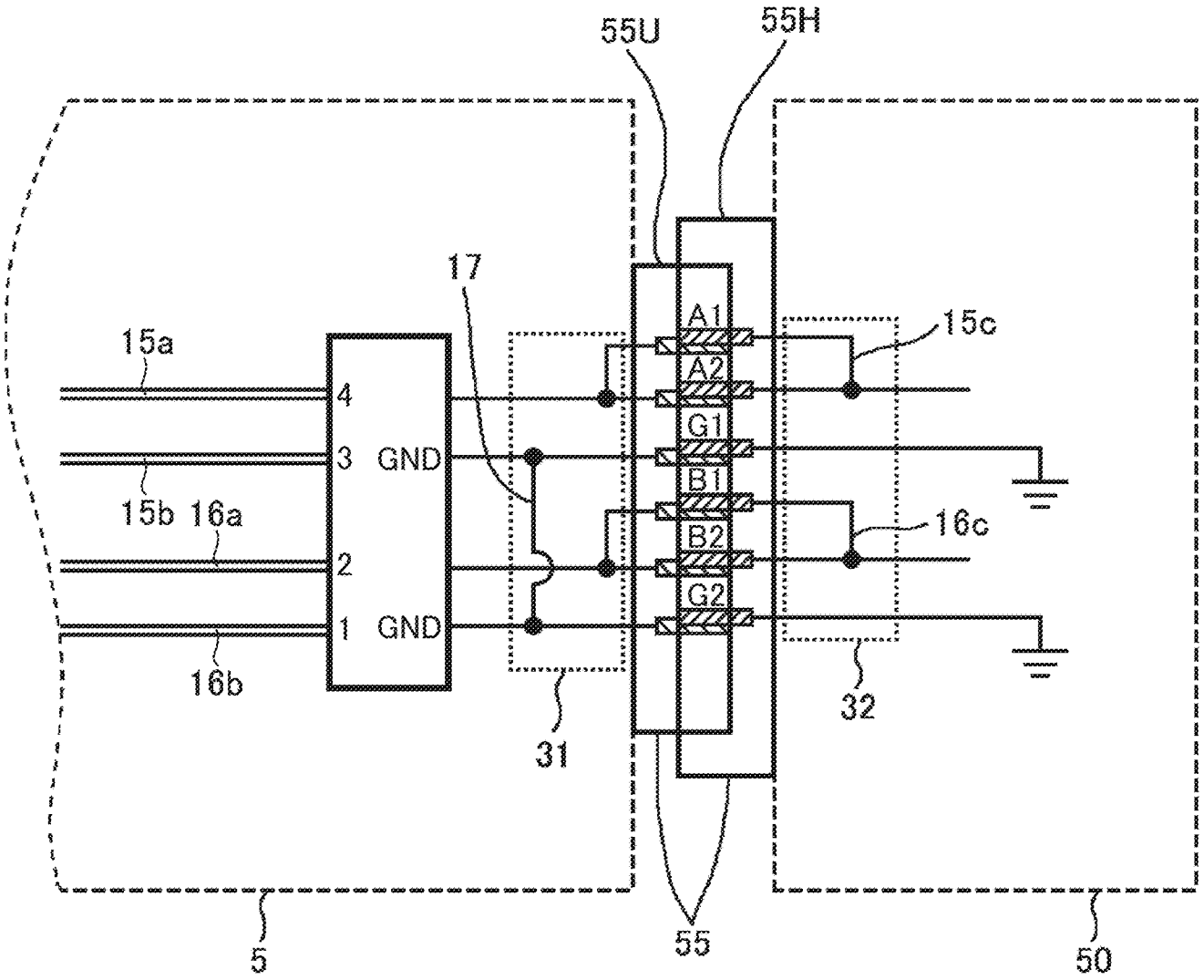
FIG. 5 is a diagram illustrating details of a connector fitting portion in a drawer connector portion.

FIG. 5 is a diagram illustrating details of a connector fitting portion at a drawer connector portion. Each of the signal wires 15*a* and 16*a* of the above-described thermistors 15 and 16 has the number of systems increased from one system to two systems at the fixing device side connector 55U and the body-side connector 55H of the drawer connector 55 by relay connectors 31 and 32. One wire is increased to a plurality of wires by each of the relay connectors 31 and 32. Additionally, the earth wires 15*b* and 16*b* of the thermistors 15 and 16 are short-circuited by the relay connector 31 at the fixing device side connector 55U of the drawer connector 55. Since such a relay connector is provided, a conventional thermistor can be used as it is. The signal wires 15*c* and 15*a* of the central thermistor 15 are connected at terminal portions A1 and A2 of the fitting portion (connecting portion) between the fixing device side connector 55U of the fixing device 5 side and the body-side connector 55H of the apparatus body 50 side. Similarly, the signal wires 16*c* and 16*a* of the end-portion thermistor 16 are connected at terminal portions B1 and B2. Additionally, the earth wires 15*b* and 16*b* of the central thermistor 15 and the end-portion thermistor 16 are connected at terminal portions G1 and G2, and the earth wires 15*b* and 16*b* are short-circuited by the short-circuit wire 17.

Furthermore, branching of each of the signal wires 15*a* and 16*a* and short-circuiting of the earth wires 15*b* and 16*b* in the fixing device side connector 55U of the fixing device 5 side are achieved via: a relay board provided in the fixing device 5; and the relay connector 31 provided in the relay board. Specifically, each of the signal wires 15*a* and 16*a* has the number of systems increased from the one system to the two systems, and the earth wires 15*b* and 16*b* are short-circuited by the short-circuit wire 17. Since the relay board is thus provided in the fixing device 5, each of the signal wires 15*a* and 16*a* can be branched by the relay connector 31 and the lead wires (wiring harness) provided in the relay board. Furthermore, assembling work efficiency can be improved. Furthermore, branching of each of the signal wires 15*a* and 16*a* at the body-side connector 55H of the apparatus body 50 side and short-circuiting of the earth wires 15*b* and 16*b* are achieved via a relay board provided in the apparatus body 50 and the relay connector 32 provided in the relay board.

Figure 6:
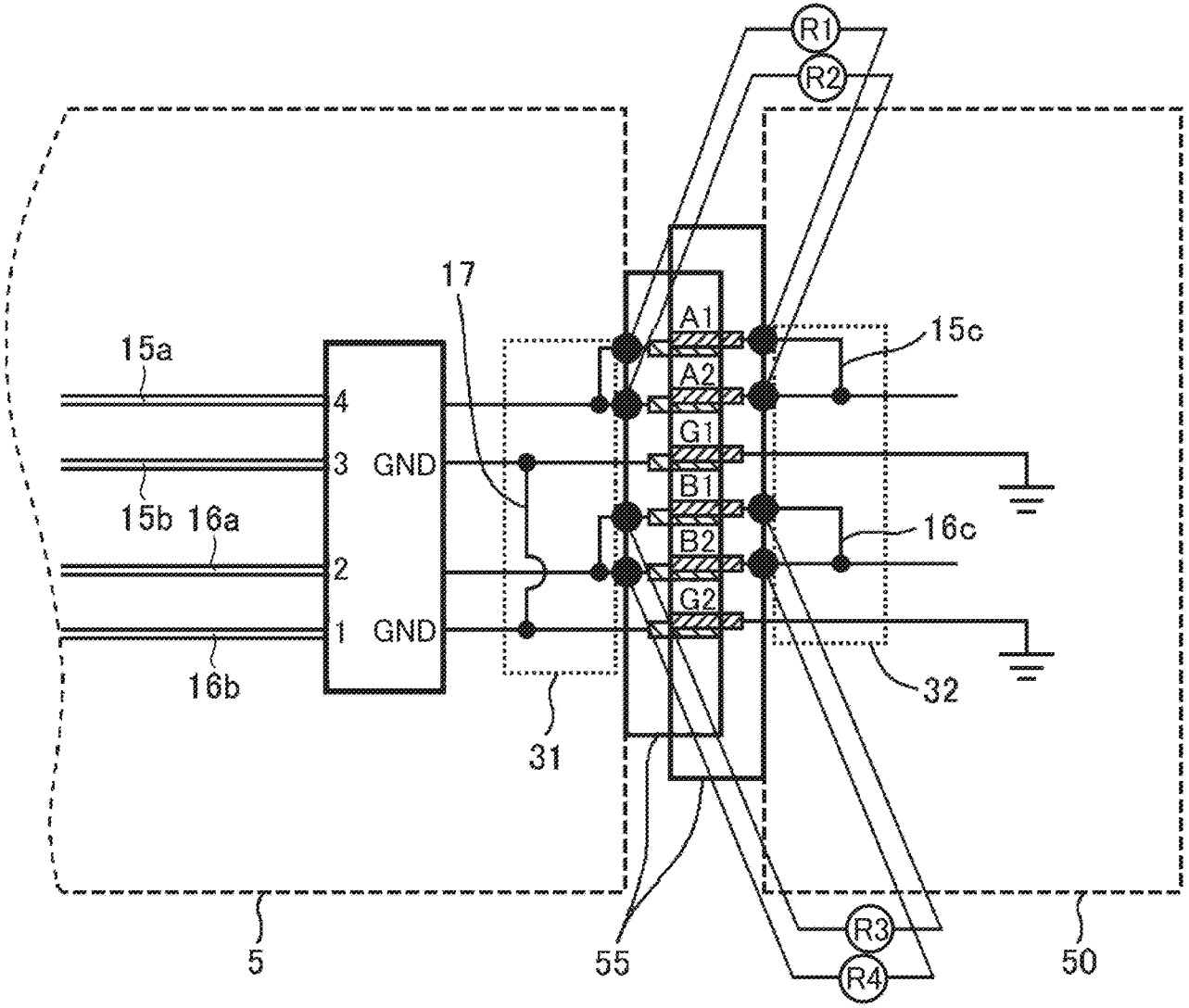
FIG. 6 is a diagram illustrating a measuring device that measures resistance at a contact place of the drawer connector portion.

FIG. 6 is a diagram illustrating a measuring device that measures resistance at a contact place of the drawer connector portion. The fixing device 5 includes the measuring devices (resistance measuring instruments) that measure resistance R1, R2, R3, and R4 at contact portions of the terminal portions on each of the fixing device 5 side and the apparatus body 50 side of terminal portions A1, A2, B1, and B2 of the signal wires of the fixing device side connector 55U and the body-side connector 55H. Detection of resistance abnormality with the measuring devices enables detection of defective contact at the drawer connector 55. In a case where the measuring devices detect R1≠R2 or R3≠R4, it is possible to determine whether one of the two signal wires connected to each of the terminal portions A1, A2, B1, and B2 is disconnected or resistance abnormality has occurred. Since a system of a signal wire or terminal is increased to a plurality of systems, even when defective contact occurs at one of the terminal portions A1 and A2, a risk of erroneous temperature detection is eliminated because: the other terminal portion keeps electrical continuity; or defective contact occurs at both of the terminal portions at the same time with extremely little possibility.

Furthermore, a versatile thermistor as conventionally used can be used as it is, and the configuration of the present embodiment can be achieved by adding the relay connectors 31 and 32 to increase the number of signal wires. Therefore, a high development cost for a new component can be suppressed. Similarly, the earth wires can be short-circuited by adding the relay connectors (in other words, a system of each earth wire is increased to a plurality of earth wires). Therefore, space saving can also be achieved.

Moreover, in a case where resistance abnormality is detected as a result of resistance measurement at terminal portions of signal wires of the drawer connector 55, a notification to prompt a user to attach and detach the fixing device 5 relative to the apparatus body 50 can be displayed on an operation panel of the image forming apparatus. Thus, the resistance abnormality at the terminal portion of the drawer connector 55 is detected and the user is made to attach and detach the fixing device relative to the apparatus body 50. As a result, a foreign substance, such as an oxide generated at the terminal portion of the drawer connector and causing defective contact, can be removed by a wiping effect to restore the terminal portion/contact portion.

As described above, according to an embodiment of the present disclosure, each thermistor includes the two lead wires as in a conventional thermistor, and the lead wires are separated into the signal wire and the earth wire. Each signal wire is branched at the drawer connector of the fixing device, and the branched signal wires are connected to the terminals obtained by the system increase from one system to two systems. On the other hand, earth wires of the thermistors are short-circuited to each other. The body-side connector also includes the terminals of the branched signal wires in a manner corresponding to the terminals of the fixing device side connector. The branched signal wires are connected on the body side. Thus, in the present embodiment, the contacts (signal paths) of the two systems (the plurality of systems) are formed in the drawer connector.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A fixing device comprising:

a fixing member:

at least one temperature detector configured to detect a temperature of the fixing member, the at least one temperature detector including a plurality of lead wires; and a device-side drawer connector having a terminal portion configured to fit with a terminal portion of a body-side drawer connector of an image forming apparatus body to connect the plurality of lead wires of the at least one temperature detector to the image forming apparatus body, wherein the device-side drawer connector is configured to branch a signal wire of the plurality of lead wires of the at least one temperature detector into a plurality of systems, wherein a plurality of earth wires of the plurality of lead wires of the at least one temperature detector is short-circuited to each other.

2. The fixing device according to claim 1, further comprising a relay connector connected to the device-side drawer connector, wherein the relay connector is configured to branch the signal wire into the plurality of systems and short-circuit the plurality of earth wires to each other.

3. The fixing device according to claim 2, further comprising a relay board including the relay connector configured to branch the signal wire into the plurality of systems and short-circuit the plurality of earth wires to each other.

4. The fixing device according to claim 1, further comprising a measuring device at the terminal portion of the signal wire of the device-side drawer connector, wherein the measuring device is configured to measure resistance of a contact portion at which the terminal portion of the signal wire of the device-side drawer connector contacts the terminal portion of the signal wire of the body-side drawer connector.

5. An image forming apparatus comprising:

the fixing device according to claim 4, and control circuitry configured to issue a notification to prompt a user to attach and detach the fixing device relative to the image forming apparatus body when the control circuitry determines that the resistance of the contact portion detected with the measuring device indicates resistance abnormality.

6. An image forming apparatus comprising the fixing device according to claim 1.

* * * * *